US010622759B2

(12) United States Patent
Shih

(10) Patent No.: US 10,622,759 B2
(45) Date of Patent: Apr. 14, 2020

(54) FIXING APPARATUS FOR CABLE CONNECTOR AND CABLE CONNECTOR ASSEMBLY USING THE SAME

(71) Applicant: HONGFUJIN PRECISION ELECTRONICS (TIANJIN) CO., LTD., Tianjin (CN)

(72) Inventor: Tung-Ho Shih, New Taipei (TW)

(73) Assignee: HONGFUJIN PRECISION ELECTRONICS (TIANJIN) CO., LTD., Tianjin (CN)

( * ) Notice: Subject to any disclaimer, the term of this patent is extended or adjusted under 35 U.S.C. 154(b) by 0 days.

(21) Appl. No.: 16/101,691

(22) Filed: Aug. 13, 2018

(65) Prior Publication Data

US 2019/0386428 A1 Dec. 19, 2019

(30) Foreign Application Priority Data

Jun. 14, 2018 (CN) ..... 2018 1 0616432

(51) Int. Cl.
*H01R 13/627* (2006.01)

(52) U.S. Cl.
CPC ..... *H01R 13/6272* (2013.01); *H01R 13/6278* (2013.01)

(58) Field of Classification Search
CPC ..... H01R 13/6272; H01R 13/6278
USPC ..... 439/595, 372
See application file for complete search history.

(56) References Cited

U.S. PATENT DOCUMENTS 6,749,458 B1 * 6/2004 Kuo ..... H01R 12/774 439/484
7,153,172 B2 * 12/2006 Milligan ..... F02M 51/005 439/752
7,479,025 B2 * 1/2009 Lee ..... H01R 13/6277 439/349
7,828,585 B2 * 11/2010 Kurimoto ..... H01R 13/02 439/357
7,867,011 B2 * 1/2011 Kato ..... H01R 13/6275 439/352
7,927,122 B2 * 4/2011 Yamaji ..... H01R 9/0515 439/342
8,075,324 B2 * 12/2011 Yamaji ..... H01R 13/6295 439/188
8,147,269 B2 * 4/2012 Yamaji ..... H01R 13/629 439/372
8,241,065 B2 * 8/2012 Ikari ..... H01R 12/775 439/372

(Continued)

*Primary Examiner* — Tulsidas C Patel
*Assistant Examiner* — Peter G Leigh
(74) *Attorney, Agent, or Firm* — ScienBiziP, P.C.

(57) ABSTRACT

A fixing apparatus for fixing at least one cable connector in a cable connector assembly includes an accommodating unit and a locking member rotatably connected to the accommodating unit. The accommodating unit includes a space accommodating the cable connector, a member fixed in the accommodating space for fixing the cable connector in place, and a first groove and a second groove. The locking member is rotatable between a locking position and an unlocking position. When the locking member is rotated to the unlocking position, the locking member is received and latched in the first groove; and when the locking member is rotated to the locking position, the locking member is received and latched in the second groove.

10 Claims, 5 Drawing Sheets

(56) References Cited

U.S. PATENT DOCUMENTS

| | | | | |
|---|---|---|---|---|
| 8,388,370 | B2 * | 3/2013 | Yamaji | H01R 13/62994 439/497 |
| 8,523,603 | B2 * | 9/2013 | Yamaji | H01R 12/57 439/493 |
| 8,550,849 | B2 * | 10/2013 | Yamaji | H01R 13/6581 439/495 |
| 8,602,812 | B2 * | 12/2013 | Ohsaka | H01R 12/775 439/497 |
| 8,647,141 | B2 * | 2/2014 | Lee | H01R 13/639 439/372 |
| 8,727,803 | B2 * | 5/2014 | Kurachi | H01R 12/88 439/497 |
| 8,727,816 | B2 * | 5/2014 | Takahashi | H01R 13/4361 439/595 |
| 8,876,544 | B2 * | 11/2014 | Yamaji | H01R 13/648 439/372 |
| 9,184,531 | B2 * | 11/2015 | Chen | H01R 13/518 |
| 9,190,776 | B2 * | 11/2015 | Lee | H01R 12/88 |
| 9,240,654 | B2 * | 1/2016 | Takemoto | H01R 12/7029 |
| 9,287,643 | B2 * | 3/2016 | Yoshida | H01R 12/75 |
| 9,337,573 | B2 * | 5/2016 | Hsu | H01R 13/62 |
| 9,893,448 | B2 * | 2/2018 | Mashima | H01R 12/774 |

* cited by examiner

100

200

FIXING APPARATUS FOR CABLE CONNECTOR AND CABLE CONNECTOR ASSEMBLY USING THE SAME

FIELD

The subject matter herein generally relates to electrical connections.

BACKGROUND

Computer and server casings are getting thinner and smaller, with limited inner space. When cable connectors are applied, such as side-by-side RADSOK connectors, the available demounting clearance is small because of the limited space around the connectors. Therefore, there is room for improvement in the art.

BRIEF DESCRIPTION OF THE DRAWINGS

Implementations of the present disclosure will now be described, by way of example only, with reference to the attached figures.

DETAILED DESCRIPTION

Figure 1:
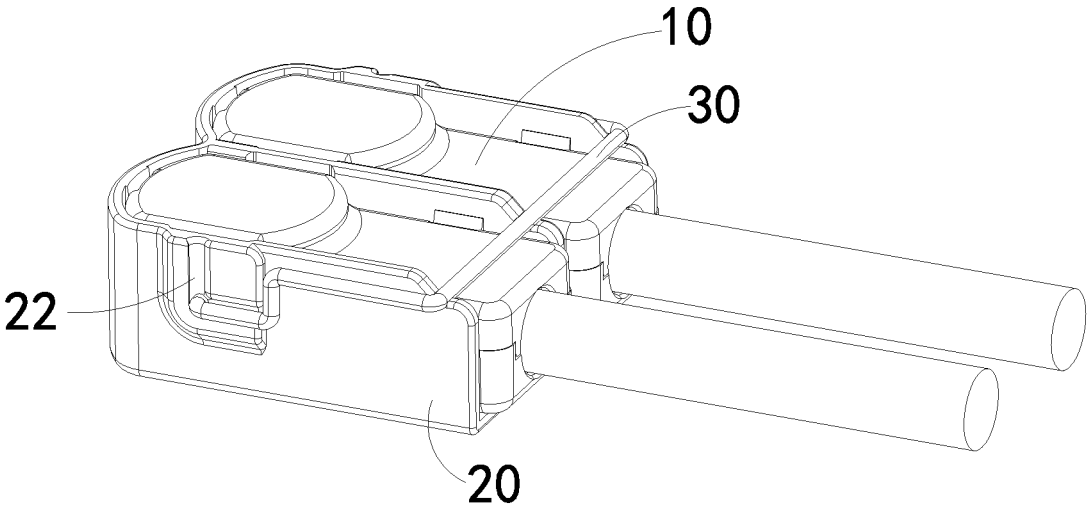
FIG. 1 is an isometric view of an embodiment of a cable connector assembly, showing a locking member in a locking position.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "comprising" means "including, but not necessarily limited to"; it specifically indicates open-ended inclusion or membership in a so-described combination, group, series, and the like.

Figure 2:
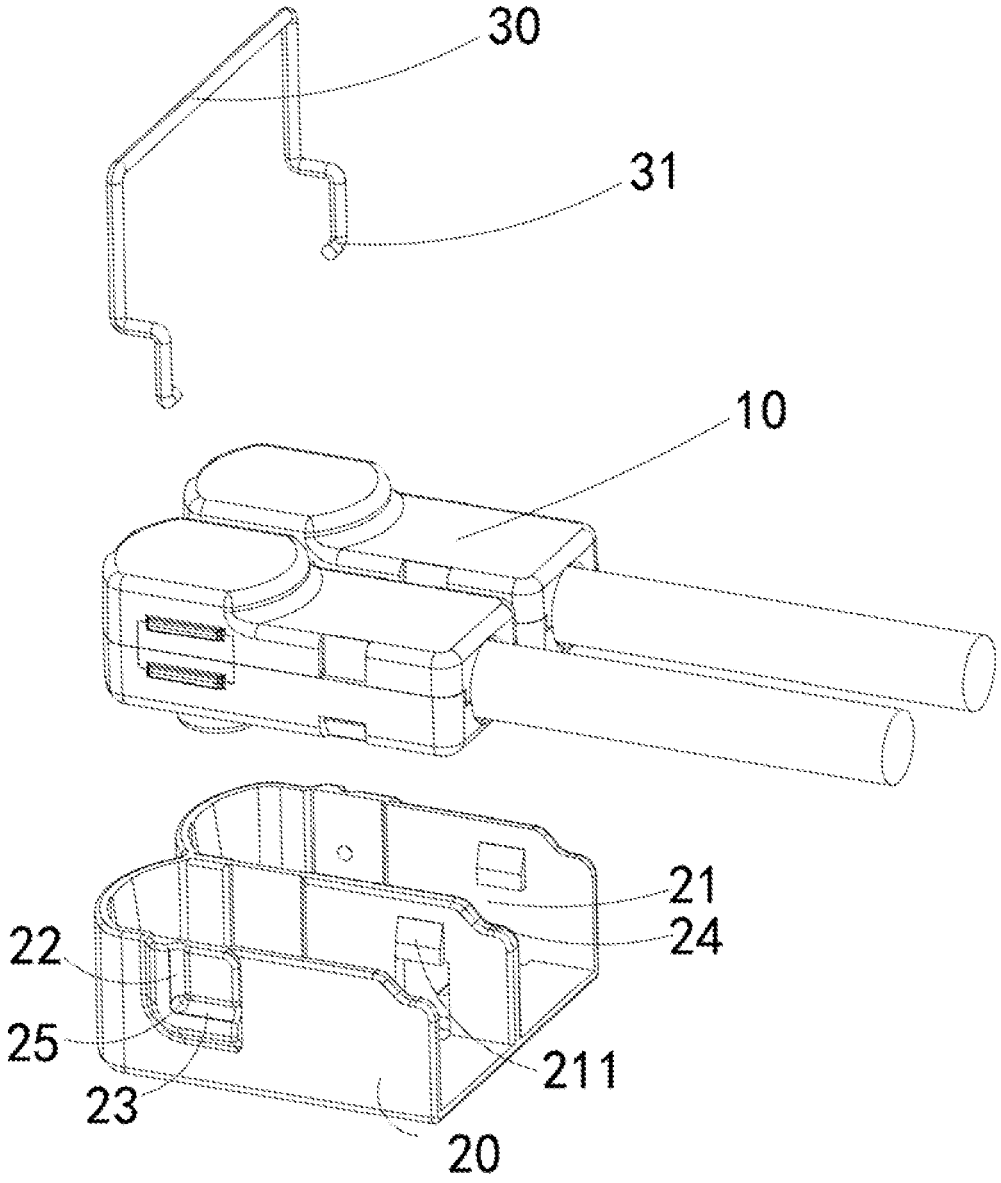
FIG. 2 is an exploded view of the cable connector assembly of FIG. 1.
Figure 3:
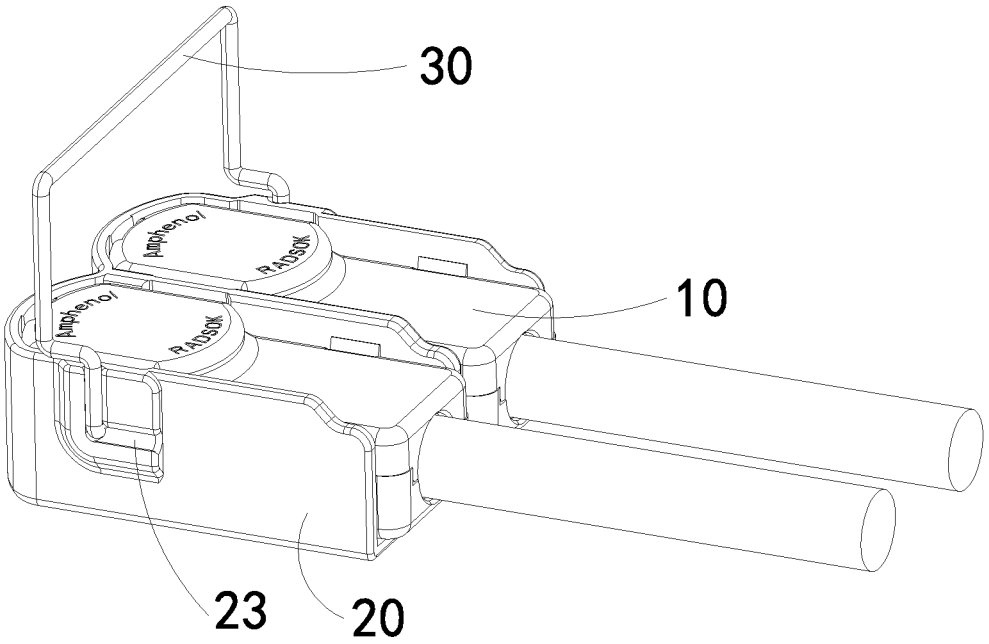
FIG. 3 is another isometric view of the cable connector assembly of FIG. 1, showing the locking member in an unlocking position.

FIG. 1-3 show a cable connector assembly 100.

The cable connector assembly 100 includes at least one cable connector 10 and a fixing apparatus 200.

Figure 4:
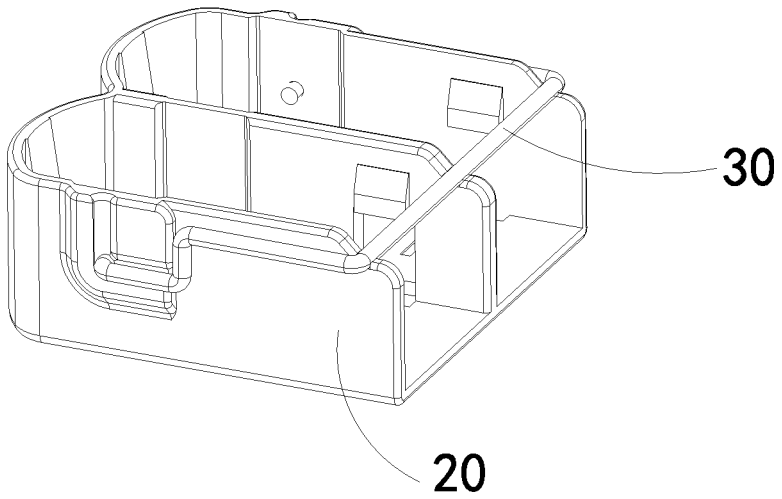
FIG. 4 is an isometric view of the fixing apparatus of the cable connector assembly of FIG. 2.
Figure 5:
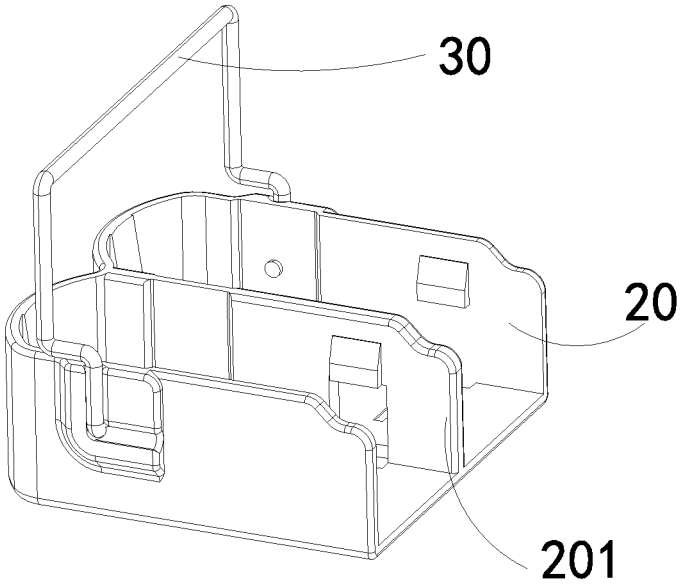
FIG. 5 is another isometric view of the fixing apparatus of FIG. 4, showing the locking member in an unlocking position.

Referring also to FIGS. 4-5, the fixing apparatus 200 is used to fix the at least one cable connector 10 in place.

The fixing apparatus 200 includes an accommodating unit 20 and a locking member 30. The locking member is rotatably connected to the accommodating unit 20.

The accommodating unit 20 includes an accommodating space 21, a retaining member 211, a first groove 22, and a second groove 23.

The accommodating space 21 is used to accommodate the cable connector 10.

The retaining member 211 is located in the accommodating space 21. The retaining member 211 retains the cable connector 10 in the accommodating space 21 by a snap-fit.

The first groove 22 and the second groove 23 are defined on the accommodating unit 20.

The locking member 30 is rotatable between a locking position (as shown in FIGS. 1 and 4) and an unlocking position (as shown in FIGS. 3 and 5).

When the locking member 30 is in the unlocking position, a part of the locking member 30 is received and latched in the first groove 22. When the locking member 30 is in the locking position, a part of the locking member 30 is received and latched in the second groove 23.

The locking member 30 can include a pivot pin 31. The accommodating unit 20 defines a through hole 25 corresponding to, and for receiving, the pivot pin 31.

The locking member 30 is rotatably connected to the accommodating unit 20 through the pivot pin 31 and the through hole 25.

The accommodating unit 20 can further include a notch 24 corresponding to the locking member 30. When notch 24 is included and locking member 30 is in the locking position, a portion of the locking member 30 is received in the second groove 23 and and another portion of the locking member 30 rests on the notch 24, allowing for saving space and creating a compact structure.

The locking member 30 can be substantially U shaped.

The retaining member 211 can be formed by embossing or other methods. In an embodiment, retaining member 211 can comprise two retaining members, defined on opposite inner surfaces of the accommodating space 21.

The accommodating unit 20 can further include an isolating plate 201. The isolating plate 201 is located in the middle of the accommodating space 21.

The isolating plate 201 divides accommodating space 21 into two separate spaces, Each space to accommodate a cable connector 10.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. A fixing apparatus for fixing at least one cable connector, comprising:

an accommodating unit comprising:

an accommodating space for accommodating the at least one cable connector;

a retaining member fixed in the accommodating space for retaining the at least one cable connector in the accommodating space;

a first groove and a second groove defined on the accommodating unit, the first groove and the second groove communicating with each other; and a through hole defined on the accommodating unit, and disposed in a connecting portion of the first groove and the second groove;

a locking member rotatably connected to the accommodating unit, comprising:

a pivot pin corresponding to the through hole, wherein the locking member is rotatably connected to the accommodating unit through the pivot pin and the through hole;

wherein the locking member is rotatable between a locking position and an unlocking position; when the locking member is in the unlocking position, a portion of the locking member close to and directly connected to the pivot pin is received and latched in the first groove; and when the locking member is in the locking position, the portion of the locking member close to and directly connected to the pivot pin is received and latched in the second groove.

2. The fixing apparatus of claim 1, wherein the accommodating unit further comprises a notch corresponding to the locking member;

when the locking member is in the locking position, the locking member is received and latched in the second groove and rests on the notch.

3. The fixing apparatus of claim 1, wherein the locking member is substantially U shaped.

4. The fixing apparatus of claim 1, wherein the retaining member comprises two retaining members, each retaining member defined on one of two opposite inner surfaces of the accommodating space.

5. The fixing apparatus of claim 1, wherein the accommodating unit further comprises an isolating plate;

the isolating plate dividing the accommodating space into two separate spaces, each space to accommodate a cable connector.

6. A cable connector assembly comprising:

at least one cable connector; and a fixing apparatus for fixing the at least one cable connector, comprising:

an accommodating unit comprising:

an accommodating space for accommodating the at least one cable connector;

a retaining member fixed in the accommodating space for fixing the at least one cable connector;

a first groove and a second groove defined on the accommodating unit, the first groove and the second groove communicating with each other; and a through hole defined on the accommodating unit, and disposed in a connecting portion of the first groove and the second groove;

a locking member rotatably connected to the accommodating unit, comprising:

a pivot pin corresponding to the through hole, wherein the locking member is rotatably connected to the accommodating unit through the pivot pin and the through hole;

wherein the locking member is rotatable between a locking position and an unlocking position; when the locking member is rotated to the unlocking position, a portion of the locking member close to and directly connected to the pivot pin is received and latched in the first groove; and when the locking member is rotated to the locking position, the portion of the locking member close to and directly connected to the pivot pin is received and latched in the second groove.

7. The cable connector assembly of claim 6, wherein the accommodating unit further comprises a notch corresponding to the locking member;

when the locking member is rotated to the locking position, the locking member is received and latched in the second groove and rests on the notch.

8. The cable connector assembly of claim 6, wherein the locking member is U shaped.

9. The cable connector assembly of claim 6, wherein the retaining member comprises two embossing respectively defined on two opposite inner surfaces of the accommodating space.

10. The cable connector assembly of claim 6, wherein the accommodating unit further comprises an isolating plate located in the middle of the accommodating space;

wherein the accommodating space is divided by the isolating plate to two spaces to accommodate two cable connectors.

* * * * *